US009646756B2

(12) United States Patent
Inagaki et al.

(10) Patent No.: US 9,646,756 B2
(45) Date of Patent: May 9, 2017

(54) POWDER MAGNETIC CORE AND METHOD FOR PRODUCING THE SAME

(75) Inventors: Takashi Inagaki, Matsudo (JP); Chio Ishihara, Tokyo (JP)

(73) Assignee: HITACHI POWDERED METALS CO., LTD., Matsudo-Shi, Chiba (JP)

( * ) Notice: Subject to any disclaimer, the term of this patent is extended or adjusted under 35 U.S.C. 154(b) by 772 days.

(21) Appl. No.: 13/637,246

(22) PCT Filed: Mar. 25, 2011

(86) PCT No.: PCT/JP2011/057363
§ 371 (c)(1),
(2), (4) Date: Sep. 25, 2012

(87) PCT Pub. No.: WO2011/118774
PCT Pub. Date: Sep. 29, 2011

(65) Prior Publication Data

US 2013/0015939 A1 Jan. 17, 2013

(30) Foreign Application Priority Data

Mar. 26, 2010 (JP) ..... 2010-073648

(51) Int. Cl.

| | |
|---|---|
| ***H01F 27/255*** | (2006.01) |
| ***B22F 1/02*** | (2006.01) |
| ***H01F 1/24*** | (2006.01) |
| ***H01F 1/33*** | (2006.01) |
| ***H01F 41/02*** | (2006.01) |

(52) U.S. Cl.
CPC ..... *H01F 27/255* (2013.01); *B22F 1/02* (2013.01); *H01F 1/24* (2013.01); *H01F 1/33* (2013.01); *H01F 41/0246* (2013.01)

(58) Field of Classification Search
CPC ..... H01F 27/255; B22F 3/12
USPC ..... 148/300
See application file for complete search history.

(56) References Cited

FOREIGN PATENT DOCUMENTS

| | | | |
|---|---|---|---|
| CN | 1615528 A | | 5/2005 |
| EP | 2226142 A1 | * | 9/2010 |
| JP | 55-138205 | | 10/1980 |

(Continued)

OTHER PUBLICATIONS

Official Action issued on Jul. 2, 2014 in the counterpart Chinese application.

(Continued)

*Primary Examiner* — Jie Yang
(74) *Attorney, Agent, or Firm* — Nath, Goldberg & Meyer; Jerald L. Meyer; Joshua B. Goldberg

(57) ABSTRACT

The present invention provides a powder magnetic core which has a low iron loss and an excellent constancy of magnetic permeability and is suitably used as a core for a reactor mounted on a vehicle. The powder magnetic core is a compact of a mixed powder containing an iron-based soft magnetic powder having an electrical insulating coating formed on its surface and a powder of a low magnetic permeability material having a heat-resistant temperature of 700° C. or higher than 700° C. and a relative magnetic permeability of not more than 1.0000004. The density of the compact is 6.7 Mg/m$^3$ or more, and the low magnetic permeability material exists in the gap among the soft magnetic powder particles in the green compact.

12 Claims, 4 Drawing Sheets

(56) References Cited

FOREIGN PATENT DOCUMENTS

| | | | |
|---|---|---|---|
| JP | 09-320830 | A | 12/1997 |
| JP | 2000-235925 | A | 8/2000 |
| JP | 2001-155914 | | 6/2001 |
| JP | 2003-217919 | A | 7/2003 |
| JP | 2003-303711 | | 10/2003 |
| JP | 2004-143554 | | 5/2004 |
| JP | 2009-120915 | A | 6/2009 |
| JP | 2009-302165 | A | 12/2009 |
| JP | 2010-263042 | | 11/2010 |
| JP | 5462356 | B2 | 1/2014 |
| WO | 2008/133172 | A1 | 11/2008 |
| WO | 2009/075173 | A1 | 6/2009 |

OTHER PUBLICATIONS

Official Action issued in Korean Patent Application No. 9-2013-068434050 dated Oct. 2, 2013, 4 pages.

Official Action issued in Japanese Patent Application No. 2012-507085 dated Oct. 22, 2013, 2 pages.

Korean Application No. 10-2012-7027593, Official Action Dated Apr. 25, 2014, three (3) pages.

Office Action issued in Chinese Application No. 201180015905.0 dated Mar. 3, 2015 (Mar. 3, 2015).

3rd office action issued in Chinese application No. 201180015905.0 dated Sep. 8, 2015.

Office Action dated Mar. 15, 2016 issued in corresponding Chinese Application No. 201180015905.0.

Official Action issued on Jul. 12, 2013 in the counterpart Japanese Application No. 2012-507085 with English abstract, twelve (12) pages total.

Official Action dated Sep. 29, 2016 corresponding to Chinese application. 201180015905.0.

Official Action dated Dec. 1, 2016 in the counterpart Indonesian application No. W00201204030.

* cited by examiner

POWDER MAGNETIC CORE AND METHOD FOR PRODUCING THE SAME

This is a National Phase Application filed under 35 U.S.C. 371 as a national stage of PCT/JP2011/057363, filed Mar. 25, 2011, and claims priority from Japanese Application No. 2010-073648, filed Mar. 26, 2010, the content of each of which is hereby incorporated by reference in its entirety.

TECHNICAL FIELD

The present invention relates to a powder magnetic core, which is formed using an iron-based soft magnetic powder having an insulating coating formed on its surface, and a method for producing the same, and relates particularly to a powder magnetic core suitably used as a core for a reactor and a method for producing the same.

BACKGROUND ART

Recently, the development of so-called low-emission vehicles such as fuel cell vehicles, electric vehicles and hybrid vehicles has been progressed. Particularly, hybrid vehicles are becoming popular both at home and abroad. In the hybrid vehicle and the like, when the voltage is stepped down from the battery voltage to the voltage for electrical equipment, or when a motor or the like is inverter-controlled, conversion from direct current to high frequency alternating current is performed through a switching power supply and the like.

A circuit of the switching power supply as described above is provided with a reactor constituted by a core (magnetic core) and a coil wound around the core. As to the performance of the reactor, the reactor is required to be of small size and have a low loss and low noise and, in addition, it is required to have stable inductance characteristics in a wide direct current range, that is, to have excellent direct current superposition characteristics. Thus, as the core for the reactor, it is preferable to use a core having a low iron loss and a stable magnetic permeability from a low magnetic field to a high magnetic field, that is, a core having excellent constancy in magnetic permeability characteristics.

In general, a core for a reactor is formed of a material such as silicon steel sheet, an amorphous thin band, oxide ferrite and the like, and the cores formed of these materials are produced by stacking plate materials, powder compacting, power compact sintering, or the like. In order to improve the direct current superposition characteristics, there is also an occasion to provide a suitable space (gap) in a magnetic path of the core to adjust an apparent magnetic permeability.

With increasing output of the motor, a core for a reactor or the like has been required to be used on a high current/high magnetic field side. In such a core for a reactor, it is preferable that the differential magnetic permeability is not reduced even on the high magnetic field side, that is, the core has an excellent constancy in magnetic permeability. However, since the core formed of a material such as silicon steel sheet, an amorphous thin band and oxide ferrite is a material having a high magnetic permeability, the magnetic flux density is saturated on the high magnetic field side, and the differential magnetic permeability, that is an inclination of a tangent of a magnetization curve, is reduced. If such a core with less constant magnetic permeability is to be used in a reactor, it is necessary to design the core in such a manner that a thickness of the gap provided in the core is increased or the number of the gap portions is increased. However, such a design of the core causes generation of a leakage magnetic flux, an increase in loss, an increase in noise and an increase in size of the reactor, and the resultant core is not preferable to mount on a vehicle in which a fuel efficiency is required or the mounting space is limited.

As a core whose material structure has unique characteristics, there is a powder magnetic core produced by compacting a powder of soft magnetic metal such as iron. In the powder magnetic core, a material yield at the time of production is high, as compared with a laminated magnetic core formed of silicon steel sheet or the like, and the material cost can be reduced. Further, the powder magnetic core has a high degree of freedom of the shape, and the characteristics can be thus improved by optimally designing the magnetic core shape. Furthermore, electrical insulation between the metal powder particles is possibly improved by mixing an electrical insulating material such as organic resins and an inorganic powders into the metal powder, or by providing an electrical insulating coating on the surface of the metal powder, whereby eddy-current loss of the magnetic core can be significantly reduced and excellent magnetic properties can be obtained especially in a high-frequency region. Based on these characteristics, the powder magnetic core has attracted attention as the core for a reactor.

As a method of producing the powder magnetic core, there is a method of compacting a mixed powder prepared by adding a thermosetting resin powder to a soft magnetic powder having an inorganic insulating coating formed on its surface and subjecting the powder compact to a resin curing treatment (for example, see Patent Citation 1). Recently, the iron loss of the powder magnetic core is required to be further reduced, and heat treatment is applied to the powder magnetic core to mitigate distortion due to compression forming of powder, so that hysteresis loss is reduced (for example, see Patent Citation 2).

CITATION LIST

Patent Citation

Patent Citation 1: Japanese Patent Application Laid-Open No. H9-320830

Patent Citation 2: Japanese Patent Application Laid-Open No. 2000-235925

SUMMARY OF INVENTION

Technical Problem

An iron loss W of a core is the sum of an eddy current loss $W_e$ and a hysteresis loss $W_h$. When representing a frequency by f, an excitation magnetic flux density by $B_m$, an intrinsic resistance value by ρ, and a thickness of a material by t, the eddy current loss $W_e$ is represented by a formula (1), and the hysteresis loss $W_h$ is represented by a formula (2). Accordingly, the iron loss W is represented by a formula (3). Here, $k_1$ and $k_2$ are coefficients.

$$W_e=(k_1B_m^2t^2/\rho)f^2 \quad (1)$$

$$W_h=k_2B_m^{1.6}f \quad (2)$$

$$W=W_e+W_h=(k_1B_m^2t^2/\rho)f^2+k_2B_m^{1.6}f \quad (3)$$

The eddy current loss $W_e$ increases in proportion to the square of the frequency f as shown in the formula (1). In the iron loss W, since the influence of the eddy current loss $W_e$ is extremely increased in a high-frequency region from several hundred kHz to several MHz as shown in the formula (3), the influence of the hysteresis loss $W_h$ in the iron loss W is relatively reduced. Thus, in the high-frequency region, it is of the highest priority and necessary that the intrinsic resistance ρ is increased to reduce the eddy current loss $W_e$.

Meanwhile, a reactor for vehicles is used at a frequency f of approximately 5 to 30 kHz, and a general reactor is used at the frequency f of approximately 30 to 60 kHz. In this region, the influence of the eddy current loss $W_e$ on the ion loss W is smaller than that in the case of the high-frequency region from several hundred kHz to several MHz, and the influence of the hysteresis loss $W_h$ is relatively increased. Thus, if the reactor is used in such a frequency region, it is necessary to reduce not only the eddy current loss $W_e$ but also the hysteresis loss $W_h$, so as to reduce the iron loss W.

In the powder magnetic core containing a resin as an electrical insulating material, the resin acts as a magnetic gap among the iron powder particles. Thus, the maximum differential magnetic permeability is low, and the constancy of magnetic permeability is excellent.

However, since the powder magnetic core is produced by compacting a soft magnetic metal powder such as iron, distortion is accumulated in the soft magnetic metal powder in the stage of compacting, and the hysteresis loss $W_h$ is large due to the distortion. In such a powder magnetic core, as in the Patent Citation 2, the powder magnetic core is heat-treated to release the distortion accumulated in the soft magnetic metal powder, whereby the hysteresis loss $W_h$ is reduced to enable to reduce the iron loss W. However, in the case where the powder magnetic core containing a resin is heat-treated, if the heat treatment temperature is too high, the resin is deteriorated and decomposed so that the electrical insulation is lost to drastically reduce the intrinsic resistance ρ, and thus, to increase the eddy current loss $W_e$, whereby the iron loss W is increased. Thus, the heat treatment temperature should be lower than the heat-resistant temperature of the resin (approximately 300° C.), and the distortion is then not completely removed. Consequently, the hysteresis loss $W_h$ cannot be satisfactorily reduced, so that the iron loss W is increased.

If the powder magnetic core is produced with no addition of resin, using only an iron-based soft magnetic powder having an electrical insulating coating such as a phosphate-based electrical insulating coating formed on its surface, the powder magnetic core is allowed to be heat-treated at high temperature, so that the hysteresis loss $W_h$ is reduced and the iron loss W is then reduced. However, since it does not contain the resin acting as the magnetic gap, its differential magnetic permeability on the high magnetic field side is extremely small with respect to the maximum differential magnetic permeability, and the constancy of magnetic permeability characteristics is reduced. Thus, as in the case of the core formed of a material such as silicon steel sheet, an amorphous thin band, oxide ferrite, etc., it is required to design so that a thickness of gap provided in the core is increased and the number of the gap portions is increased.

As described above, there is a demand for a magnetic core suitably used as a core for a reactor mounted on a vehicle and having a low iron loss and an excellent constancy of magnetic permeability.

An object of the present invention is to provide a powder magnetic core having a low iron loss and an excellent constancy of magnetic permeability, which is suitably used as a core for a reactor mounted on a vehicle.

Technical Solution

According to one aspect of the present invention, a powder magnetic core is composed of a mixed powder comprising: an iron-based soft magnetic powder whose surface has an electrical insulating coating; and a powder of a low magnetic permeability material having a heat-resistant temperature of 700° C. or higher than 700° C. and a relative magnetic permeability lower than a relative magnetic permeability of air, wherein the density of the compact is 6.7 $Mg/m^3$ or more than 6.7 $Mg/m^3$ and the low magnetic permeability material exists in a gap among particles of the iron-based soft magnetic powder in the compact.

It is preferable that an average particle size of the microparticulated particles of the low magnetic permeability material powder is 10 μm or less than 10 μm. It is also preferable that the maximum particle size is 20 μm or less than 20 μm.

It is preferable that the magnetic permeability of the powder magnetic core in which the low magnetic permeability material exists in the gap among the particles of the soft magnetic powder is 60 to 140, and that at least one kind of $Al_2O_3$, $TiO_2$, MgO, $SiO_2$, SiC, AlN, talc, kaolinite, mica and enstatite is contained. The additive amount of the low magnetic permeability material powder is preferably 0.05 to 1.5% by volume, and more preferably 0.1 to 1% by volume.

Advantageous Effects of Invention

According to the present invention, it is possible to provide a powder magnetic core having a low iron loss and excellent constancy of magnetic permeability characteristics, and accordingly, a core for a reactor mounted on a vehicle in which stability of the magnetic permeability in a wide range of frequency region is improved is possibly provided.

MODE FOR CARRYING OUT THE INVENTION

Figure 1:
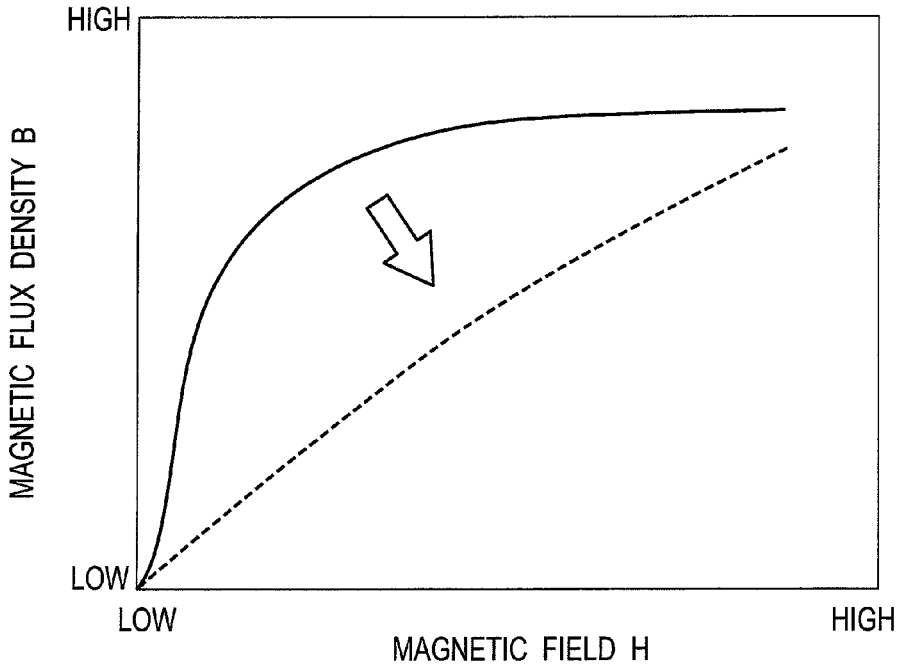
FIG. 1 is an explanatory illustration of direct current magnetization characteristics of a core.

In the usual core formed of a material such as silicon steel sheet, an amorphous thin band and oxide ferrite, as shown by the solid line in FIG. 1, the magnetic flux density is saturated on the high magnetic field side, and the differential magnetic permeability that is an inclination of a tangent of a magnetization curve is reduced. Since a core for a reactor used on a high current/high magnetic field side is required to have an excellent constancy of magnetic permeability, it is preferred that the core exhibits magnetization characteristics in which the differential magnetic permeability is not reduced even on the high magnetic field side as shown by the dashed line in FIG. 1. In the powder magnetic core, a resin with low magnetic permeability and a magnetic gap such as a pore (a gap among soft magnetic powder particles) are dispersed, and therefore, the constancy of magnetic permeability is commonly excellent. However, the characteristics on the high current/high magnetic field side are not enough yet.

In the present invention, a powder magnetic core is produced using an iron-based soft magnetic powder having an electrical insulating coating formed on its surface but does not contain a resin, and a powder of a low magnetic permeability material with high heat resistance and a magnetic permeability lower than that of air is present in the green compact, whereby iron loss can be reduced by heat treatment at high temperature, and, at the same time, constancy of magnetic permeability of the powder magnetic core can be improved. In this connection, it has been found that the importance is to make the powder of the low magnetic permeability material unevenly distribute in the gap among the particles of the soft magnetic powder. By intensively distributing the low magnetic permeability material in the gap among the soft magnetic powder particles that usually serves as a pore, the low magnetic permeability material can be dispersed without reducing a space factor of the soft magnetic powder in the powder magnetic core. Therefore, variation of the magnetic permeability can be suppressed as shown in FIG. 1, while the saturation magnetic flux density is not reduced and the iron loss is maintained low.

Hereinafter, the present invention will be described in detail. Here, it is noted that, in the present invention, a unit "% by volume" representing the mixing ratio of powder means a percentage based on a volume calculated from the true density and the mass of material, but is not a value depending on bulkiness of powder or the like. Accordingly, preparation in actual practice of the invention can be performed in terms of mass units.

To reduce the iron loss of the powder magnetic core while holding the constant magnetic permeability as an advantage of the powder magnetic core, it is effective to set high the heat-treatment temperature after the powder compacting, so as to release the distortion at the compacting and satisfactorily reduce the hysteresis loss. In order to realize this, it is preferable that the heat-treatment temperature is set to 500° C. or higher than 500° C., and more preferably approximately 600° C. or higher than 600° C. In the case where the heat-treatment temperature is raised high as mentioned above, it is important to select, as a material added to the electrical insulation-coated iron-based soft magnetic powder constituting the powder magnetic core, a material having a resistance against the heat-treatment temperature (namely, having a melting point or decomposition point being higher than the heat-treatment temperature, and preferably higher by 50° C. or more). Thus, the low magnetic permeability material used in the present invention is not an organic material like the resins, but a low magnetic permeability material whose heat-resistant temperature is 700° C. or higher than 700° C. is selected. Consequently, the powder magnetic core can be heat-treated at high temperature (for example, at 500° C. or higher than 500° C.), and the hysteresis loss can be reduced. Here, the heat-resistant temperature means the highest temperature at which the magnetic permeability is not changed by a composition change, a state change, etc. due to thermal decomposition and so on. Namely, it is required that the magnetic permeability of the low magnetic permeability material is not changed by the heat-treatment temperature, and the heat-resistant temperature is lower than the melting point and the decomposition point. Therefore, the requirement that the heat-resistant temperature is 700° C. or higher means that the melting point and the decomposition point are higher than 700° C.

Figure 2:
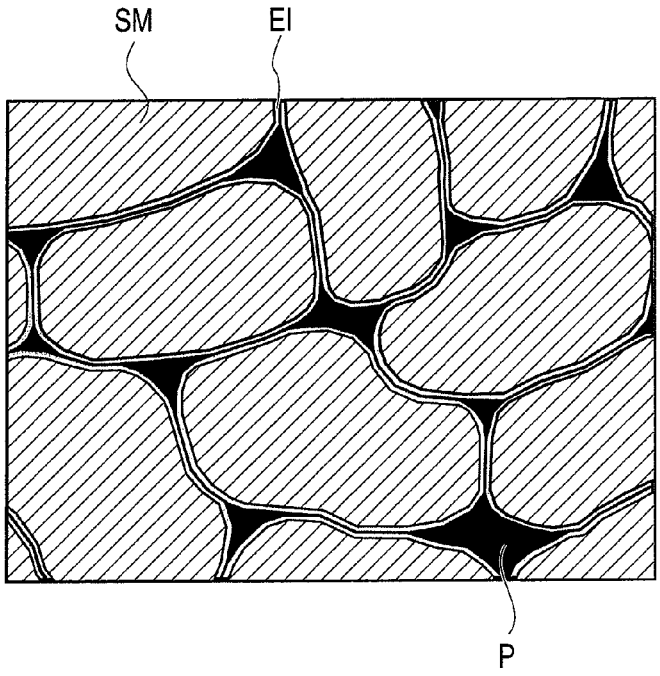
FIG. 2 is a schematic view showing an example of a metallographic structure of a conventional powder magnetic core.

As schematically shown in FIG. 2, in the powder magnetic core which does not contain a resin with low heat resistance and is formed of only an iron-based soft magnetic powder particles SM having an electrical insulating coating EI formed on its surface, pores P (black portions in FIG. 2) are formed in the gap among the soft magnetic powder particles SM, and the pores P are filled with air. When magnetic permeability of vacuum is 1, a relative magnetic permeability of air is 1.0000004, and, in the powder magnetic core with a density of approximately 6.7 $Mg/m^3$, the magnetic permeability of the powder magnetic core whose pores P are filled with air is approximately 250.

Figure 3:
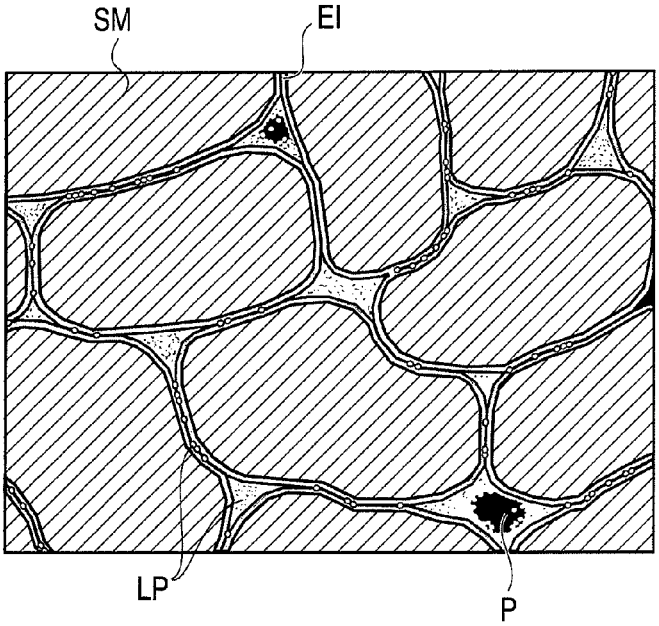
FIG. 3 is a schematic view showing an example of a metallographic structure of a powder magnetic core of the present invention.

As compared with above, in the powder magnetic core of the present invention, as schematically shown in FIG. 3, a low magnetic permeability material LP having a magnetic permeability lower than that of air is present in the gap among the iron-based soft magnetic powder particles SM each having the electrical insulating coating EI formed on its surface. Namely, in the powder magnetic core of the present invention, magnetic permeability of the gap portion is reduced by replacing a part or whole of air in the pores formed in the gap among the iron-based soft magnetic powder particles each having an insulating coating formed on its surface, with the low magnetic permeability material. The porosity is also reduced. As described above, the powder of low magnetic permeability material with a magnetic permeability lower than that of air is localized in the gap among the iron-based soft magnetic powder particles as described above, and thus the maximum differential magnetic permeability of the powder magnetic core is reduced without reducing the saturation magnetic flux density and a difference from the differential magnetic permeability on the high magnetic field side is reduced. Consequently, the constancy of magnetic permeability can be improved.

In the powder magnetic core of the present invention, the low magnetic permeability material is present mainly in the gap among the soft magnetic powder particles. However, this does not mean that the low magnetic permeability material held by the soft magnetic powder particles be eliminated, and a portion of the low magnetic permeability material may be present so as to be sandwiched between the iron-based soft magnetic powder particles each having an electrical insulating coating formed on its surface. Such a low magnetic permeability material held by the iron-based soft magnetic powder particles does not contribute toward replacing the air in the gap among the soft magnetic powder particles, but it contributes to reduction in the magnetic permeability between the iron-based soft magnetic powder particles. It is only required that the low magnetic permeability material is present in at least a part of a large number of gap portions among the soft magnetic powder particles. It is preferable that the low magnetic permeability material is present in all the gap portions among the soft magnetic powder particles, but that is not essential. Further, although it is preferable that the low magnetic permeability material exists so as to fill the gap, the present invention is not limited thereto and the low magnetic permeability material may partially exist so as to incompletely fill the gap. The air in an amount corresponding to the volume of the existing low magnetic permeability material is replaced so that the effect of the reduction of the magnetic permeability can be obtained by that much. If a material having a high specific resistance is used as the low magnetic permeability material, it also contributes to improvement of the insulation property of the iron-based soft magnetic powder particles.

If the density of the powder magnetic core is low, the space factor of the soft magnetic powder is reduced and the magnetic flux density is thus reduced. Moreover, the iron loss is increased and, at the same time, the magnetic permeability is notably reduced on the high magnetic field side. Therefore, it is preferable that the density is not less than 6.7 $Mg/m^3$. The density is measured by an Archimedes method. More specifically, the density is measured by the method specified in Japanese Industrial Standard Z2501. In order to form a high-density powder magnetic core as described above, a powder with an average particle size (median size) of approximately 50 to 150 μm is preferably used as the insulating-coated iron-based soft magnetic powder. Here, it is noted that, although the thickness of the electrical insulating coating is emphasized in FIG. 3 for the purpose of explanation, the thickness of the electrical insulating coating is typically approximately 10 to 200 nm and it is in fact considerably smaller than the illustrated one, so that the thickness can be ignored for the particle size of the insulating-coated iron-based soft magnetic powder.

As the iron-based soft magnetic powder, powdered iron-based metals that include pure iron and ferrous alloys such as Fe—Si alloy, Fe—Al alloy, permalloy, sendust and the like are usable, and pure iron powder is excellent in terms of its high magnetic flux density and compressibility.

In the electrical insulating coating formed on the surface of the soft magnetic powder, it is only required that the insulation properties are kept at the heat-treatment temperature described above. However, it is preferable to use a phosphate-containing electrical insulating coating in terms of strength of a green compact because the phosphate-containing electrical insulating coatings are bound to each other by heat treatment. The soft magnetic powder coated with an inorganic insulating coating can be suitably selected from commercial products, or a coating of an inorganic compound may be formed on the surfaces of the soft magnetic powder particles in accordance with a known method. For example, according to the Patent Citation 1 (Japanese Patent Laid-Open Publication No. H9-320830), an aqueous solution containing phosphoric acid, boric acid and magnesium is mixed with an iron powder, and the mixture is dried to obtain an insulating-coated soft magnetic powder in which an inorganic insulating coating of approximately 0.7 to 11 g is formed on the surface of 1 kg iron powder.

Upon varying the excitation magnetic field from 0 to 10000 A/m, where the maximum differential magnetic permeability of the powder magnetic core reached in the meantime is represented by $\mu_{max}$ and the differential magnetic permeability at 10000 A/m is represented by $\mu_{10000\ A/m}$, if the ratio of $\mu_{10000\ A/m}$ to $\mu_{max}$ is less than 0.15, the magnetic flux density is saturated on the high magnetic field side to lose the function as a reactor. Accordingly, it is preferable to use the powder magnetic core in which the ratio of $\mu_{10000\ A/m}$ to $\mu_{max}$ is 0.15 or more than 0.15. In the present invention, such constancy of magnetic permeability is realized by introducing the low magnetic permeability material as shown in FIG. 3.

Since the low magnetic permeability material is used to reduce the magnetic permeability of the gap portions among the soft magnetic powder particles as described above, the magnetic permeability of the low magnetic permeability material is required to be less than the relative magnetic permeability of air: 1.0000004. When such a low magnetic permeability material that the magnetic permeability of the powder magnetic core having the low magnetic permeability material in its gap portions is 60 to 130 (that is, not more than half the magnetic permeability of the powder magnetic core whose gap portions are filled with air) is used, the constancy of magnetic permeability of the powder magnetic core is significantly improved and it is thus preferable. However, if such a material that the magnetic permeability of the powder magnetic core is less than 60 is used as the low magnetic permeability material, the influence of interfering with the magnetic flux of the soft magnetic powder increases although the constancy of magnetic permeability is improved. Accordingly, the differential magnetic permeability in the magnetic field until the magnetic flux density reaches the saturation magnetic flux density is excessively reduced. With these factors, it is preferable that the magnetic permeability of the powder magnetic core having the low magnetic permeability material in the gap portions is in the range of 60 to 130.

As the low magnetic permeability material, it is preferable to select at least one kind, specifically, from inorganic low magnetic permeability materials consisting of oxides, carbides, nitrides, and silicate minerals. For example, inorganic compounds and minerals such as $Al_2O_3$, $TiO_2$, MgO, $SiO_2$, SiC, AlN, talc, kaolinite, mica, enstatite and the like are exemplified, and it is preferable to use at least one kind selected from them. Also, a plurality of kinds of them can be suitably combined to use.

If a powder composed of minute particles is used as the low magnetic permeability material powder, the powder is easily filled in the gap among the iron-based soft magnetic powder particles. Therefore, it is preferable that a low magnetic permeability material powder whose average particle size is 10 μm or less than 10 μm in median size is added to the iron-based soft magnetic powder, and that having the average particle size of 3 μm or less than 3 μm is more preferable. Further, its maximum particle size is preferably 20 μm or less than 20 μm, and more preferably 10 μm or less than 10 μm. As a method of microparticulating the low magnetic permeability material powder, for example, a method of grinding the powder using a jet mill, a planetary ball mill or the like can be suitably used. In the case where a low magnetic permeability material which is hard to be microparticulated by this method or the like is used, other methods such as freezing and grinding may be used. As the method for adjusting the particle size of the microparticulated low magnetic permeability material to the above average particle size (median size) and the maximum particle size, there is a method of classifying particles in accordance with the pneumatic classification method, for example. The particle size can be then suitably adjusted using a pneumatic classifier or the like.

In the powder magnetic core of the present invention, since the iron-based soft magnetic powder (insulating-coated iron-based soft magnetic powder) having the electrical insulating coating formed on its surface is used, the surface of the iron-based soft magnetic powder is electrically insulated to be neutralized. The low magnetic permeability material is also electrically substantially neutral. Accordingly, the low magnetic permeability material powder is hardly adhered to the surface of the insulating-coated iron-based soft magnetic powder. Moreover, the size of the particles of the low magnetic permeability material is smaller than the size of the insulating-coated iron-based soft magnetic powder, and the particles of the low magnetic permeability material fit into the gap among the magnetic powder particles. Therefore, when a mixed powder prepared by mixing the insulating-coated iron-based soft magnetic powder with the powder of low magnetic permeability material is pressed and formed into a compact, the particles of the low magnetic permeability material powder tend to easily escape into the gap among the iron-based soft magnetic powder particles and to be localized to them.

It is preferable that the additive amount of the powder of low magnetic permeability material is 0.05 to 1.5% by volume of the total amount of the mixed powder. If the additive amount is less than 0.05% by volume, a sufficient effect cannot be obtained. If the additive amount is more than 1.5% by volume, the space factor of the iron-based soft magnetic powder is reduced and it is difficult to increase the density of green compact, resulting in that the iron loss increases as the magnetic flux density decreases and thus that is not preferable.

The insulating-coated iron-based soft magnetic powder and the low magnetic permeability material powder mentioned above are mixed to prepare a mixed powder, the mixed powder in an amount corresponding to a desired compact density is weighed based on the volume of the powder magnetic core to be produced, and the mixed powder is pressed and formed in a die for powder magnetic core, whereby a green compact in which the low magnetic permeability material is intensively distributed in the gap among the soft magnetic powder particles as shown in FIG. 3 is obtained. If the mixed powder in the die is lightly shaken, the compression degree of the mixed powder is easily improved. To form the green compact with a high density of 6.7 $Mg/m^3$ or more than 6.7 $Mg/m^3$, a high compacting pressure of approximately 1000 MPa is usually applied. Therefore, it is meaningful for satisfactory mitigation of distortion to employ a high temperature of 500° C. or higher than 500° C. in subsequent heat treatment.

In regard to the above description, if a small amount of dispersant is added upon mixing the iron-based soft magnetic powder and the low magnetic permeability material powder, aggregation of the minute low magnetic permeability material powder is prevented, which enables more uniform mixing and is thus preferable. Examples of the dispersant include silica hydrate dispersion liquid as an aqueous liquid material, and fluxes such as calcium silicate and like materials as a solid.

The green compact obtained as described above is subjected to heat treatment at approximately 500 to 700° C. for 10 to 60 minutes, whereby distortion caused at compacting the powder is satisfactorily mitigated, and the hysteresis loss of the powder magnetic core to be obtained is reduced. The powder magnetic core obtained has a density of 6.7 $Mg/m^3$ or more than 6.7 $Mg/m^3$ and has a structure in which the heat-resistant low magnetic permeability material is intensively localized in the gap among the insulating-coated iron-based soft magnetic powder particles. Accordingly, the space factor of the soft magnetic powder can be held to at least the range of approximately 85 to 95% by volume, and the porosity is typically at most the range of approximately 3.5 to 14.95% by volume. Thus, while the iron loss is kept small, the maximum magnetic permeability is reduced so that the ratio of $\mu_{10000\ A/m}$ to $\mu_{max}$ can be increased. The space factor and the porosity of the soft magnetic powder in the powder magnetic core can be specified by impregnating the powder magnetic core with varnish or the like, taking an image of its cut and polished cross section with an optical microscope, and then measuring an area of a soft magnetic powder portion or a porous portion from the image with use of image analysis software (for example, Win ROOF manufactured by Mitani Corporation). In this case, the optical microscope image is taken to grayscale and the obtained grayscale image is analyzed with Win ROOF. In this analysis, a threshold value is adjusted in accordance with the Mode method to binarize for the pore portion and a portion including the soft magnetic powder and the low magnetic permeability material, and the grains to be measured are separated and analyzed accordingly, thereby obtaining the porosity for the pore portion. Moreover, the threshold value is adjusted again to binarize for a portion including the pore and the low magnetic permeability material and a portion of the soft magnetic powder, and the analysis is performed, whereby the space factor can be obtained for the soft magnetic powder portion. An area ratio of the low magnetic permeability material can be obtained from these analytic values, and this area ratio can be approximately used as a value of the volume ratio.

Figure 4:
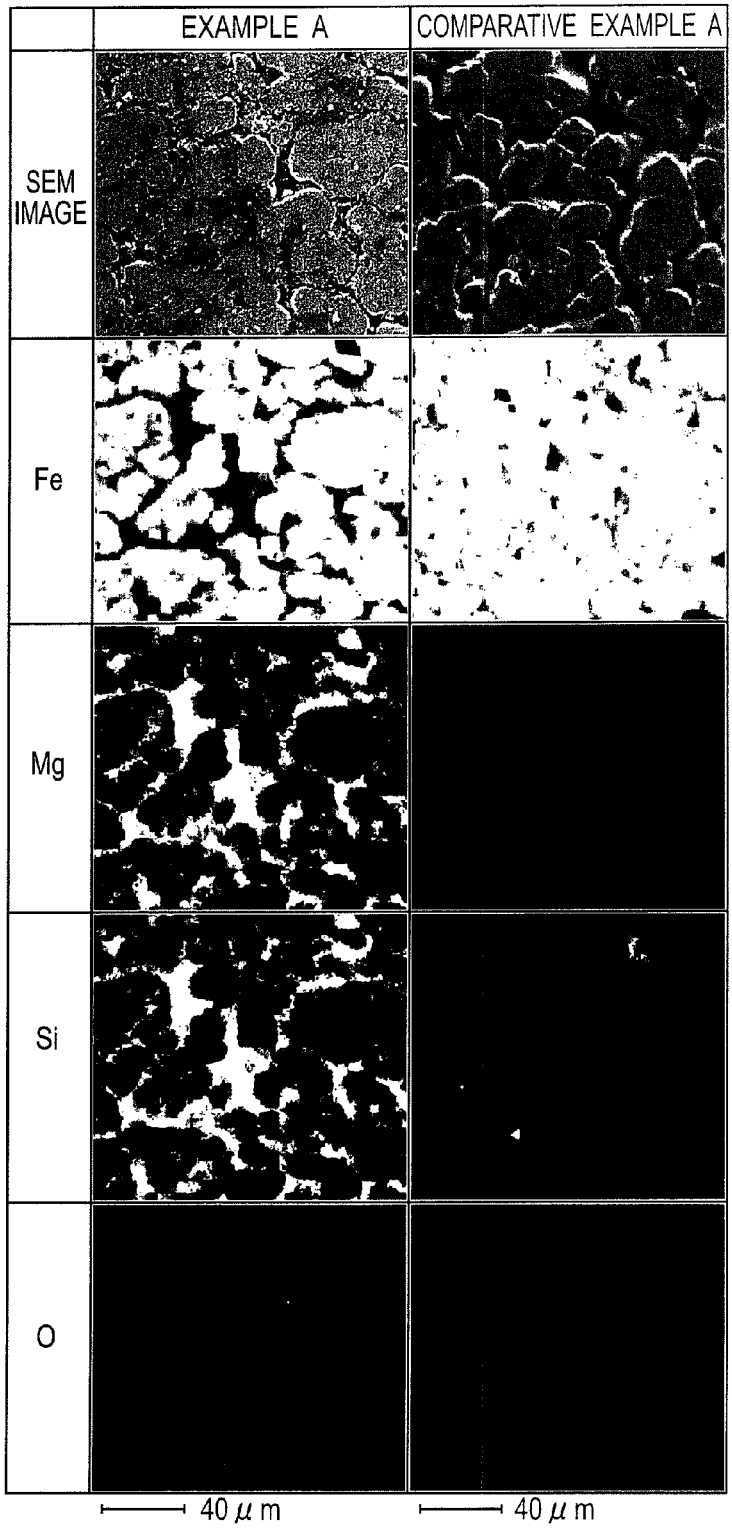
FIG. 4 is a view showing the results of EPMA analysis of an end surface of each of the powder magnetic core of the present invention and the conventional powder magnetic core.

FIG. 4 shows an SEM (Scanning Electron Microscope) image and images showing distribution of elements, Fe, Mg, Si and O, the SEM image being observed by enlarging a punched surface of a green compact, obtained by compacting the raw powder using a pair of upper and lower punches, by 1000 times by an EPMA (Electron Probe MicroAnalyser). An example A is a green compact that is obtained by preparing a mixed powder in which 1.5% by volume of talc ($Mg_3Si_4O_{10}(OH)_2$) being a kind of silicate mineral is added as the low magnetic permeability material powder to a pure iron powder subjected to coating treatment for forming a phosphate-based electrical insulating coating, filling the mixed powder as a raw powder in a hole of a die body, and compacting it by pressing in a vertical direction with the upper and lower punch. A comparative example A is a green compact obtained by similarly compacting a raw powder composed of only a pure iron powder subjected to the coating treatment for forming a phosphate-based electrical insulating coating.

In the SEM image of FIG. 4, the example A is different from the comparative example A in that a dark gray portion different from a light gray portion is observed. Viewing the images of elemental distribution for these portions, Fe is distributed in the light gray portion while Fe is not distributed and Mg, Si and O as components of talc are distributed in the dark gray portion. Accordingly, it is found that the light gray portion is the pure iron powder, and the dark gray portion is talc. Talc is relatively intensively localized, and it is faced on the same surface to the pure iron powder and close contacts to the pure iron powder with no clearance therebetween. Therefore, it is found that this portion corresponds to the gap among the pure iron powder particles and the gap is filled with talc. Although it is appeared that the amount (area) of the gap is different between the example A and the comparative example A, the sum of the areas of the dark gray portion and the gap (pores) in the example A is substantially equivalent to the total area of the gap (pores) in the comparative example A. Namely, the areas occupied by the pure iron powder are substantially the same. In the SEM image of the example A, although pores are observed, Mg, Si and O as the components of talc are detected at portions in contact with the pores. This means that the low magnetic permeability material accounts for a part of the gap among the soft magnetic powder particles, and the rest of gap is remained as pores. With all these factors, it is found that, when a raw powder prepared by adding and mixing the low magnetic permeability material powder to and with the iron-based soft magnetic powder that is subjected to the electrical insulating coating treatment as prescribed above is pressed to form into a compact, the low magnetic permeability material is possibly disposed in the gap among the soft magnetic powder particles to replace the air in the gap with the low magnetic permeability material.

Regarding the powder magnetic core of the present invention, the area ratio of the low magnetic permeability material can be specifically confirmed as follows. Namely, elemental distribution is measured for one or a plurality of kinds of main elements composing the low magnetic permeability material, based on the image data taken by EPMA as described above, and the image of the elemental distribution thus obtained is analyzed with image analysis software (for example, Win ROOF manufactured by Mitani Corporation) to measure the distribution area of the measured element. Accordingly, the area ratio of the low magnetic permeability material can be specified. In this case, elemental mapping in EPMA is performed using grayscale, and the obtained grayscale image is analyzed with Win ROOF. In this analysis, the threshold is set to 80 in accordance with the Mode method to binarize, and the grains to be measured are separated and thus analyzed, whereby the area ratio can be obtained. If the elemental mapping is performed for a plurality of kinds of elements, the area ratio of the low magnetic permeability material is obtained as an average value of the values obtained for the respective elements. Here, it is noted that, according to the measurement principle, the sensitivity in detection of a light element is lowered in the analysis using an EPMA apparatus. Therefore, if the elements composing the low magnetic permeability material include an element other than the light elements such as H, N, C and O, it is preferable in terms of accuracy to measure the distribution area using that element as the target element to be analyzed.

When producing the powder magnetic core at the additive amount of the low magnetic permeability material being 0.05 to 1.5% by volume, the area ratio of the low magnetic permeability material determined according to the above description is 1.5 to 30.0%.

EXAMPLES

As the low magnetic permeability material powder, $Al_2O_3$, $TiO_2$, MgO, $SiO_2$, SiC, AlN, talc, kaolinite and mica were microparticulated and classified by a pneumatic classifier, respectively, to prepare a powder with an average particle size (radian size) of 3.0 μm. Further, $Al_2O_3$ powders having different average particle sizes ranging from 0.05 to 20 μm were prepared as shown in Table 1.

Meanwhile, a surface of a pure iron powder with an average particle size of 75 μm is coated with a phosphate-based electrical insulating coating with reference to the Patent Citation 1, and this was used as an insulating-coated soft magnetic powder in the following operation.

In accordance with Table 1, the low magnetic permeability material powder was added to and mixed with the insulating-coated soft magnetic powder to prepare a raw powder (samples 2 to 28 and 30 to 34). For the sake of comparison, an insulating-coated soft magnetic powder (sample 1) without addition of the low magnetic permeability material powder and a mixed powder (sample 29) prepared by adding 0.5% by volume of polyimide-based resin powder as the low magnetic permeability material powder to the insulating-coated soft magnetic powder were also provided as a raw powder.

In each of samples, amount of the raw powder was weighed so as to form a green compact having a compact density of 6.9 $Mg/m^3$ (samples 1, 2 and 9 to 34) or each value described in Table 1 (samples 3 to 8), and it was pressed to form a compact of an annular test piece with an inner diameter of 20 mm, an outer diameter of 30 mm and a thickness of 5 mm. Then the test pieces of sample numbers 1 to 28 were subjected to heat treatment at 650° C., and the test piece of sample number 29 was subjected to heat treatment at 200° C. The test pieces of sample numbers 30 to 34 were obtained in a similar manner to that of sample 13 except that the heat-treatment temperature was changed to a range of 200 to 600° C. described in Table 1.

The iron loss of the obtained test piece was measured under the conditions of a frequency of 10 kHz and an excitation magnetic flux density of 0.1 T. Further, the specific ratio of each test piece was measured by the four probe method. Furthermore, the excitation magnetic field was varied from 0 to 10000 A/m, while a magnetic flux density $B_{10000A/m}$ at 10000 A/m, a maximum differential magnetic permeability $\mu_{max}$, and a differential magnetic permeability $\mu_{10000A/m}$ at 10000 A/m were measured for each test piece. The measurement results are shown in Table 1.

Further, direct current superposition characteristics (L-I characteristics) were evaluated using the test pieces of samples 1 and 13, and the effect of addition of the low magnetic permeability material on the L-I characteristics was examined.

TABLE 1

| | Low magnetic permeability material | | | | Green | Heat | | | | | | |
|---|---|---|---|---|---|---|---|---|---|---|---|---|
| Sample No. | Kind | Additive amount vol % | Additive amount mass % | Average particle size μm | compact density $Mg/m^3$ | treatment temperature ° C. | Iron loss $kW/m^3$ | Specific resistance μΩm | $B_{10000\ A/m}$ T | $\mu_{max}$ | $\mu_{10000\ A/m}$ | $\mu_{10000\ A/m}$/μmax |
| 01 | no add. | — | — | — | 6.9 | 650 | 160 | 105 | 1.30 | 291 | 30 | 0.10 |
| 02 | $Al_2O_3$ | 0.05 | 0.1 | 3.0 | 6.9 | 650 | 152 | 120 | 1.25 | 212 | 31 | 0.15 |
| 03 | $Al_2O_3$ | 0.1 | 0.2 | 3.0 | 6.6 | 650 | 169 | 202 | 0.81 | 108 | 22 | 0.20 |
| 04 | $Al_2O_3$ | 0.1 | 0.2 | 3.0 | 6.7 | 650 | 155 | 140 | 0.92 | 130 | 26 | 0.20 |
| 05 | $Al_2O_3$ | 0.1 | 0.2 | 3.0 | 6.9 | 650 | 140 | 140 | 1.04 | 143 | 33 | 0.23 |
| 06 | $Al_2O_3$ | 0.1 | 0.2 | 3.0 | 7.0 | 650 | 130 | 140 | 1.10 | 153 | 37 | 0.24 |
| 07 | $Al_2O_3$ | 0.1 | 0.2 | 3.0 | 7.1 | 650 | 125 | 140 | 1.28 | 160 | 37 | 0.23 |
| 08 | $Al_2O_3$ | 0.1 | 0.2 | 3.0 | 7.2 | 650 | 122 | 137 | 1.35 | 170 | 33 | 0.19 |
| 09 | $Al_2O_3$ | 0.5 | 1.0 | 0.05 | 6.9 | 650 | 139 | 206 | 1.01 | 126 | 32 | 0.25 |
| 10 | $Al_2O_3$ | 0.5 | 1.0 | 0.1 | 6.9 | 650 | 138 | 198 | 1.06 | 132 | 33 | 0.25 |
| 11 | $Al_2O_3$ | 0.5 | 1.0 | 0.5 | 6.9 | 650 | 135 | 198 | 1.08 | 132 | 34 | 0.26 |
| 12 | $Al_2O_3$ | 0.5 | 1.0 | 1.0 | 6.9 | 650 | 137 | 193 | 1.08 | 133 | 33 | 0.25 |
| 13 | $Al_2O_3$ | 0.5 | 1.0 | 3.0 | 6.9 | 650 | 135 | 192 | 1.10 | 138 | 34 | 0.25 |
| 14 | $Al_2O_3$ | 0.5 | 1.0 | 5.0 | 6.9 | 650 | 139 | 163 | 1.18 | 152 | 31 | 0.20 |
| 15 | $Al_2O_3$ | 0.5 | 1.0 | 7.0 | 6.9 | 650 | 142 | 135 | 1.24 | 159 | 30 | 0.19 |
| 16 | $Al_2O_3$ | 0.5 | 1.0 | 10.0 | 6.9 | 650 | 143 | 130 | 1.26 | 173 | 30 | 0.17 |

TABLE 1-continued

| Sample No. | Low magnetic permeability material Kind | Additive amount vol % | Additive amount mass % | Average particle size μm | Green compact density $Mg/m^3$ | Heat treatment temperature ° C. | Iron loss $kW/m^3$ | Specific resistance μΩm | $B_{10000\ A/m}$ T | $\mu_{max}$ | $\mu_{10000\ A/m}$ | $\mu_{10000\ A/m}$/ μmax |
|---|---|---|---|---|---|---|---|---|---|---|---|---|
| 17 | $Al_2O_3$ | 0.5 | 1.0 | 20.0 | 6.9 | 650 | 158 | 122 | 1.27 | 271 | 32 | 0.12 |
| 18 | $Al_2O_3$ | 1.0 | 2.0 | 3.0 | 6.9 | 650 | 126 | 220 | 0.98 | 99 | 31 | 0.31 |
| 19 | $Al_2O_3$ | 1.5 | 3.0 | 3.0 | 6.9 | 650 | 120 | 250 | 0.88 | 84 | 29 | 0.35 |
| 20 | $Al_2O_3$ | 2.0 | 4.0 | 3.0 | 6.9 | 650 | 135 | 290 | 0.74 | 64 | 22 | 0.34 |
| 21 | $TiO_2$ | 0.5 | 1.0 | 3.0 | 6.9 | 650 | 143 | 176 | 1.16 | 150 | 30 | 0.20 |
| 22 | MgO | 0.5 | 1.0 | 3.0 | 6.9 | 650 | 143 | 170 | 1.19 | 152 | 32 | 0.21 |
| 23 | $SiO_2$ | 0.3 | 1.0 | 3.0 | 6.9 | 650 | 129 | 158 | 1.20 | 146 | 33 | 0.23 |
| 24 | SiC | 0.4 | 1.0 | 3.0 | 6.9 | 650 | 129 | 123 | 1.22 | 156 | 30 | 0.19 |
| 25 | AlN | 0.4 | 1.0 | 3.0 | 6.9 | 650 | 125 | 150 | 1.22 | 173 | 31 | 0.18 |
| 26 | Talc | 0.3 | 1.0 | 3.0 | 6.9 | 650 | 122 | 192 | 1.01 | 93 | 30 | 0.32 |
| 27 | Kaolinite | 0.3 | 1.0 | 3.0 | 6.9 | 650 | 140 | 181 | 1.06 | 121 | 30 | 0.25 |
| 28 | Mica | 0.4 | 1.0 | 3.0 | 6.9 | 650 | 135 | 186 | 1.00 | 115 | 31 | 0.27 |
| 29 | Polyimide-based resin | 1.5 | 0.25 | 3.0 | 6.9 | 200 | 271 | 220 | 0.93 | 60 | 20 | 0.33 |
| 30 | $Al_2O_3$ | 0.5 | 1.0 | 3.0 | 6.9 | 200 | 270 | 281 | 0.87 | 56 | 33 | 0.59 |
| 31 | $Al_2O_3$ | 0.5 | 1.0 | 3.0 | 6.9 | 300 | 238 | 273 | 0.89 | 77 | 32 | 0.42 |
| 32 | $Al_2O_3$ | 0.5 | 1.0 | 3.0 | 6.9 | 400 | 214 | 268 | 0.95 | 92 | 33 | 0.36 |
| 33 | $Al_2O_3$ | 0.5 | 1.0 | 3.0 | 6.9 | 500 | 159 | 220 | 1.00 | 111 | 34 | 0.31 |
| 34 | $Al_2O_3$ | 0.5 | 1.0 | 3.0 | 6.9 | 600 | 143 | 209 | 1.08 | 124 | 34 | 0.27 |

According to Table 1, when samples 1, 2, 5 and 13 to 20 which are different in the additive amount of the low magnetic permeability material powder but the same in other conditions are compared with each other, samples 2, 5 and 13 to 20 containing the low magnetic permeability material powder have a lower iron loss compared with sample 1 that does not contain the low magnetic permeability material powder. Further, the iron loss is reduced as the additive amount of the low magnetic permeability material powder increases, and the effect of reducing the iron loss is seen in the addition of 0.05% or more than 0.05% by volume of the low magnetic permeability material powder.

It has been found that a main factor of the reduction of the iron loss due to the addition of the low magnetic permeability material is not reduction of the eddy current loss due to improvement of insulation properties, but is reduction of the hysteresis loss. Although the cause of this phenomenon is not clear, it is considered that this is because the added low magnetic permeability material powder acts as a lubricant to reduce friction between the soft magnetic powder particles in the powder compacting and thus reduce plastic deformation of the soft magnetic powder particles.

In sample 20 in which the additive amount of the low magnetic permeability material powder is more than 1.5% by volume, the magnetic flux density is reduced. Accordingly, the cross-sectional area of the core is required to be increased in the case where the powder magnetic core is used as an iron core for a reactor, and that causes the reactor to be made large in size. Therefore, it is not preferable for applications in which mounting space is limited, such as a case for mounting on a vehicle.

Although it is confirmed that the iron loss is increased as the green compact density is reduced from the measurement results of samples 3 to 8, the effect of reducing the iron loss can be obtained by the addition of the low magnetic permeability material powder as described above. Therefore, in the present invention, it is understood that the density of 6.7 $Mg/m^3$ or more than 6.7 $Mg/m^3$ is suitable, in order to obtain the powder magnetic core usable as an iron core for a reactor with regard to the iron loss.

It is found that the effects of reducing the iron loss and increasing the specific resistance are small in sample 17 that contains $Al_2O_3$ with an average particle size of 20 μm, while the effects of reducing the iron loss and increasing the specific resistance are large in samples 9 to 16 that contain the low magnetic permeability material powder with an average particle size of 10 μm or less than 10 μm. Particularly, in samples 9 to 13 containing the low magnetic permeability material powder with an average particle size of 3 μm or less than 3 μm, it is clear that the effect of increasing the specific resistance is large.

In sample 1 that does not contain the low magnetic permeability material powder, the ratio of $\mu_{10000\ A/m}$ to $\mu_{max}$ is low, and the magnetic permeability is significantly reduced on the high magnetic field side. However, it is found that, by virtue of the addition of the low magnetic permeability material powder, $\mu_{max}$ is kept low and the ratio of $\mu_{10000\ A/m}$ to $\mu_{max}$ is increased to improve the constancy of magnetic permeability (samples 2 to 34). That effect is increased as the additive amount of the low magnetic permeability material powder is increased, and the effect of improving the constancy of magnetic permeability is seen in the addition of 0.05% or more than 0.05% by volume of the low magnetic permeability material powder.

In sample 8 in which the green compact density is 7.2 $Mg/m^3$, the magnetic flux density is high, but $\mu_{max}$ is high and the ratio of $\mu_{10000\ A/m}$ to $\mu_{max}$ is thus slightly low, as compared with samples 5 to 7 in which the density is 6.6 to 7.1 $Mg/m^3$. Accordingly, in a case where the magnetic flux density is more emphasized among the magnetic flux density and the constancy of magnetic permeability as the characteristics required for the powder magnetic core, it is preferable to set the green compact density to be 7.1 $Mg/m^3$ or more than 7.1 $Mg/m^3$. Meanwhile, if the constancy of magnetic permeability is more emphasized, it is preferable to set the green compact density to be 7.1 $Mg/m^3$ or less than 7.1 $Mg/m^3$.

Figure 5:
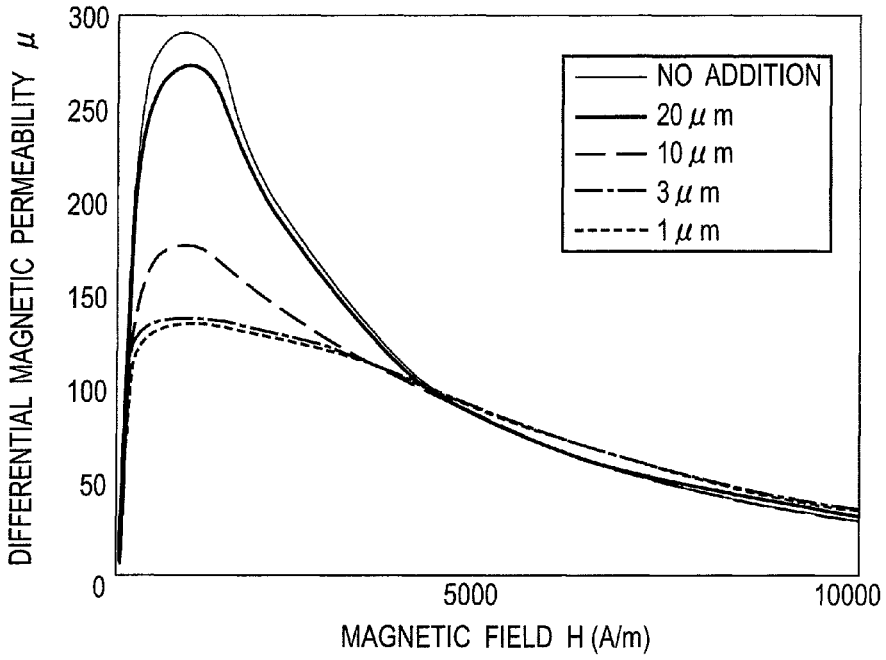
FIG. 5 is a view showing the relationship between an excitation magnetic field and a differential magnetic permeability in the powder magnetic core of the present invention.

In order to evaluate the effect of particle size of the low magnetic permeability material powder to be added, in regard to samples 11, 12, 13, 16 and 17, a relationship between an excitation magnetic field and the differential magnetic permeability of each sample is shown in FIG. 5. Even when the low magnetic permeability material with an average particle size of 20 μm is added, $\mu_{max}$ cannot be kept low and the ratio of $\mu_{10000\ A/m}$ to $\mu_{max}$ is thus reduced. Contrastively, when adding the low magnetic permeability material with an average particle size of 10 μm or less than 10 μm, the constancy of magnetic permeability is improved. Particularly, it is found that the effect is large when the low magnetic permeability material powder with an average particle size of 3 μm or less than 3 μm is added.

Figure 6:
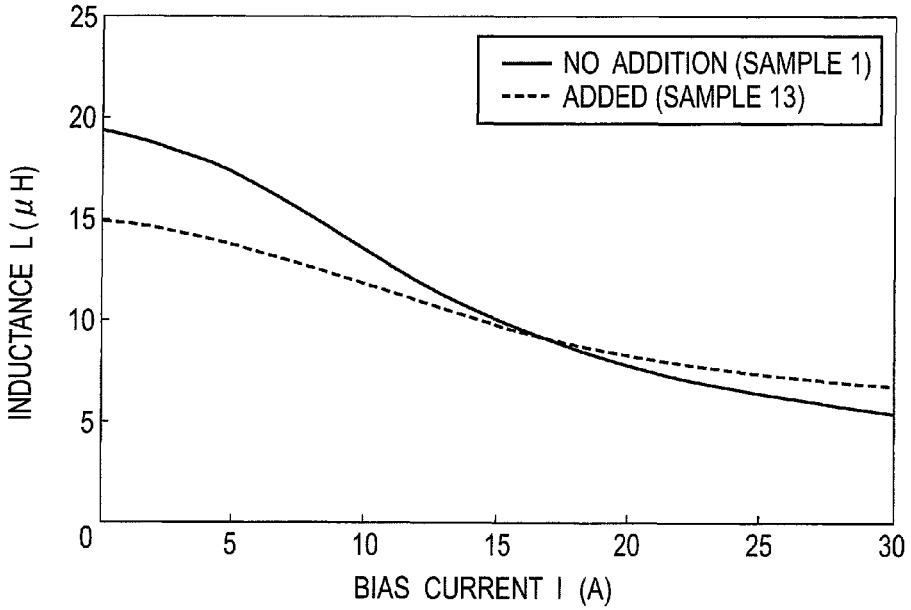
FIG. 6 is a view showing L-I characteristics of the powder magnetic core of the present invention.

FIG. 6 shows a result obtained by evaluating the L-I characteristics with use of the test pieces of samples 1 and 13 and examining the effect of the addition of the low magnetic permeability material powder on the L-I characteristics. It is found that, in the powder magnetic core of sample 13 containing the low magnetic permeability material powder, a high inductance value can be maintained to a high current side. Accordingly, by virtue of the use of the powder magnetic core of the present invention, a burden on the design, such as increase in the thickness of the gap provided in the core and increase in the number of the gap portions, is reduced so that a reactor can be reduced in size.

In sample 29 containing 1.0% by volume of a polyimide-based resin as the low magnetic permeability material powder, since the density of the resin is low, a theoretical density of the raw powder is low, and the green compact density is relatively low. Additionally, since the heat-treatment temperature cannot be set high due to use of the resin, the heat-treatment is applied at 200° C., resulting in that the iron loss is significantly high.

From the measurement results of samples 30 to 34 and 13, although the distortion of the powder magnetic core is not sufficiently removed at a heat-treatment temperature of less than 500° C. and the iron loss is large, the iron loss of the powder magnetic core is significantly reduced at a heat-treatment temperature of 500° C., and the iron loss is further reduced as the heat treatment temperature increases.

INDUSTRIAL APPLICABILITY

The present invention can provide a powder magnetic core which can be suitably used as an iron core for a magnetic circuit required for size reduction, such as a transformer, a reactor and a choke coil, and particularly a reactor mounted on a vehicle, and which has a low iron loss, and, at the same time, has excellent constancy of magnetic permeability and direct current superposition characteristics. Especially, the powder magnetic core is suitable for application in a frequency region from several kHz to less than 100 kHz.

The invention claimed is:

1. A powder magnetic core comprising:

a compact of a mixed powder comprising: an iron-based soft magnetic powder whose surface has an electrical insulating coating; and a powder of a low magnetic permeability material having a heat-resistant temperature of 700° C. or higher than 700° C. and a relative magnetic permeability lower than a relative magnetic permeability of air, wherein an amount of the powder of the low magnetic permeability material in the mixed powder is 0.05 to 1.5% by volume, the relative magnetic permeability of the low magnetic permeability material is lower than 1.0000004, the low magnetic permeability material exists to replace a part, or all, of the air in a gap among particles of the iron-based soft magnetic powder in the compact and reduce magnetic permeability of the gap from the air, an average particle size of the powder of the low magnetic permeability material is 1 to 20 μm, the compact has a cross section or a surface in which an area ratio of the low magnetic permeability material is 1.5 to 30% when the cross section or the surface is observed at a magnification ratio of 1000 times, and the density of the compact is 6.7 $Mg/m^3$ or more than 6.7 $Mg/m^3$.

2. The powder magnetic core according to claim 1, wherein an iron loss is 150 $kW/m^3$ or less than 150 $kW/m^3$ at a frequency of 10 kHz in an excitation magnetic flux density of 0.1 T.

3. The powder magnetic core according to claim 1, wherein a magnetic permeability is 60 to 140.

4. The powder magnetic core according to claim 1, wherein a space factor of the soft magnetic powder is 85 to 95% by volume, a porosity of the compact is 3.5 to 14.95% by volume, and the low magnetic permeability material is at least one of oxide, carbide, nitride, and silicate mineral.

5. The powder magnetic core according to claim 4, wherein the low magnetic permeability material is at least one of $Al_2O_3$, $TiO_2$, MgO, $SiO_2$, SiC, AlN, talc, kaolinite, mica and enstatite.

6. The powder magnetic core according to claim 1, wherein the iron-based soft magnetic powder with a surface that has the electrical insulating coating has an average particle size of 50 to 150 μm, and an average particle size of the powder of the low magnetic permeability material is 0.05 to 10 μm.

7. The powder magnetic core according to claim 1, wherein the maximum particle size of the powder of the low magnetic permeability material is 20 μm.

8. The powder magnetic core according to claim 1, used as an iron core of a reactor mounted on a vehicle.

9. A powder magnetic core comprising:

a compact of a mixed powder comprising: an iron-based soft magnetic powder whose surface has an electrical insulating coating; and a powder of a low magnetic permeability material having a heat-resistant temperature of 700° C. or higher than 700° C. and a relative magnetic permeability lower than a relative magnetic permeability of air, wherein an amount of the powder of the low magnetic permeability material in the mixed powder is 0.05 to 1.5% by volume, the relative magnetic permeability of the low magnetic permeability material is lower than 1.0000004, the low magnetic permeability material exists to replace a part, or all, of the air in a gap among particles of the iron-based soft magnetic powder in the compact and reduce magnetic permeability of the gap from the air, an average particle size of the powder of the low magnetic permeability material is 1 to 20 μm, and the compact has a cross section or a surface in which an area ratio of the low magnetic permeability material is 1.5 to 30% when the cross section or the surface is observed at a magnification ratio of 1000 times.

10. The powder magnetic core according to claim 9, used as an iron core of a reactor mounted on a vehicle.

11. A powder magnetic core, comprising:

a compact of a mixed powder comprising: an iron-based soft magnetic powder whose surface has an electrical insulating coating; and a powder of a low magnetic permeability material having a heat-resistant temperature of 700° C. or higher than 700° C. and a relative magnetic permeability lower than a relative magnetic permeability of air, wherein an amount of the powder of the low magnetic permeability material in the mixed powder is 0.05 to 1.5% by volume, the relative magnetic permeability of the low magnetic permeability material is lower than 1.0000004, the low magnetic permeability material exists to replace a part, or all, of the air in a gap among particles of the iron-based soft magnetic powder in the compact and reduce magnetic permeability of the gap from the air, the compact has a cross section or a surface in which an area ratio of the low magnetic permeability material is 1.5 to 30% when the cross section or the surface is observed at a magnification ratio of 1000 times, an average particle size of the powder of the low magnetic permeability material is 1 to 20 μm, and wherein a ratio of $\mu_{10000\ A/m}$ to $\mu_{max}$ being 0.15 or more than 0.15, upon changing an excitation magnetic field from 0 to 10000 A/m, where $\mu_{max}$ represents a maximum differential magnetic permeability of the powder magnetic core and $\mu_{10000\ A/m}$ represents a differential magnetic permeability at 10000 A/m.

12. The powder magnetic core according to claim 11, used as an iron core of a reactor mounted on a vehicle.

* * * * *